US007518321B2

(12) United States Patent
Chang et al.

(10) Patent No.: US 7,518,321 B2
(45) Date of Patent: Apr. 14, 2009

(54) LUMINANCE ADJUSTING DEVICE

(75) Inventors: Ke-Chin Chang, Hsinchu (TW); Hung-Chen Kao, Taoyuan County (TW); Hsin-Chieh Lai, Hsinchu (TW)

(73) Assignee: Hannstar Display Corporation, Taipei (TW)

( * ) Notice: Subject to any disclaimer, the term of this patent is extended or adjusted under 35 U.S.C. 154(b) by 0 days.

(21) Appl. No.: 11/954,240

(22) Filed: Dec. 12, 2007

(65) Prior Publication Data

US 2008/0088261 A1 Apr. 17, 2008

Related U.S. Application Data

(62) Division of application No. 10/907,105, filed on Mar. 21, 2005, now Pat. No. 7,327,097.

(51) Int. Cl.
*H05B 37/02* (2006.01)

(52) U.S. Cl. ..... 315/307; 315/149; 315/312; 315/360

(58) Field of Classification Search ..... 315/161, 315/169.2–169.4, 291, 294, 297, 307–308, 315/312, 360, 149–159; 345/82, 94, 102
See application file for complete search history.

(56) References Cited

U.S. PATENT DOCUMENTS

| | | | | |
|---|---|---|---|---|
| 6,337,542 | B1 * | 1/2002 | Hanaki et al. | 315/169.3 |
| 6,667,585 | B2 * | 12/2003 | O'Meara | 315/291 |
| 7,332,879 | B2 * | 2/2008 | Kung et al. | 315/307 |
| 2005/0151716 | A1 * | 7/2005 | Lin | 345/102 |
| 2005/0219188 | A1 * | 10/2005 | Kawabe et al. | 345/94 |
| 2005/0248299 | A1 * | 11/2005 | Chemel et al. | 315/312 |

* cited by examiner

*Primary Examiner*—David Hung Vu
*Assistant Examiner*—Tung X Le
(74) *Attorney, Agent, or Firm*—Jianq Chyun IP Office

(57) ABSTRACT

The invention is directed to a light module, which allows the individual lamp unit to be replaced with a new one and the luminance of the newly-replaced lamp unit can be automatically or manually adjusted to get a uniform luminance. Wherein, information of a first relation table of a lamp luminance versus a using time and a second relation table of the lamp luminance versus an operation current-power is used to determine the current power. In addition, a clocking unit is used to count a total using time for the light module. Then, a desired lamp luminance according to the first relation table can be determined, and then the current power is determined according to the second relation table.

4 Claims, 10 Drawing Sheets

LUMINANCE ADJUSTING DEVICE

CROSS-REFERENCE TO RELATED APPLICATION

This application is a divisional of an application Ser. No. 10/907,105, filed on Mar. 21, 2005, now allowed. The entirety of each aforesaid patent application is hereby incorporated by reference herein and made a part of this specification.

BACKGROUND OF THE INVENTION

1. Field of Invention

The present invention relates to a luminance adjusting device. More particularly, the present invention relates to a luminance adjusting device for automatically adjusting luminance of a lamp unit.

2. Description of Related Art

Display is the key tool to display communication information as an image manner for viewing by people. For example, computer system or TV system need a display for displaying the image. Recently, the display technology has been greatly developed. The display mechanism for panel display, such as the liquid crystal display (LCD), is quite different from the rather conventional cathode-ray-tube (CRT) display, and has been successfully developed. The LCD device usually needs a light module, such as a backlight module, to serve as the light source, so that each image pixel can produce the desired color light, and then a full image is formed.

A conventional LCD is, for example, shown in FIG. 1. In FIG. 1, the LCD 100 includes a bezel frame 102. A displaying cell assembly 104 for displaying the image is held by the frame 102. Then, several device elements, such as a plastic frame 106, an optical film & diffuser plate 108, lamp holders 110*a*, 110*b*, a light module 112, a reflection sheet 114, and a back cover 116 are sequentially stacked behind the displaying cell assembly 104, so as to form the LCD 100. The location 118 is for signal input.

For the conventional LCD 100 in FIG. 1, the light module 112 is composed by several lamp units, such as the cold cathode fluorescent lamps (CCFLs). All of the lamp units are assembled together as an integrated light module. If one of the lamp units is damaged and needs to be changed, then it is necessary to replace the whole light module. This causes the high cost in maintenance. In order to solve this issue, another design of the light module is allowing each lamp unit to be individually control in power and therefore each the lamp unit can be individually replaced.

FIG. 2 is a drawing, schematically illustrating another LCD with the light module having several replaceable lamp units. In FIG. 2, the bezel frame 102 and the displaying cell assembly of the LCD are shown. Then, the backlight module is composed of several lamp units 200. Each lamp units 200 can be separately controlled in power and replaceable.

The design of light module in FIG. 2 still has the disadvantages. The design of FIG. 2 allows each lamp unit 200 to be replaceable, so that it is not necessary to replace the whole light module. However, since the luminance (brightness) of the lamp is usually reducing according to the total operation time of the lamp, the newly replaced lamp unit usually has the stronger luminance than the luminance of the other lamp units. This phenomenon is described in FIG. 3. In FIG. 3, when a new lamp unit 302 replaces the old lamp at the region 304 in the display area 300, the distribution of the luminance is schematically shown in the right drawing. As one can see, the luminance (Lum) at the region 304 is larger. For the actual displayed image, a brighter stripe in the display screen would appear. This non-uniform luminance causes the poor quality for the displayed image. Particularly, the defect lamp unit to be replaced usually has been operated for a long time period. In this situation, the luminance for the other old lamp units has been significantly reduced. At this moment, the luminance levels between the other old lamp units and the newly added lamp unit have been quite different. This then causes the poor image quality.

The design to solve the foregoing conventional issues is still in need by the manufacturers.

SUMMARY OF THE INVENTION

The invention provides a light module, which can be used in a panel display to serve as a backlight module. The light module allows the individual lamp unit to be replaced with a new one and the luminance of the newly-replaced lamp unit can be automatically or manually adjusted to get a uniform luminance.

The invention provides a light module, which is suitable for use in a display to serve as a light source. The light module, for example, comprises a plurality of lamp units. In addition, a control unit is implemented with an information of a first relation curve of a lamp luminance versus a using time and a second relation curve of the lamp luminance versus an operation current-power. A clocking unit is used to accumulate a total using time for the light module when it is turned on. A power-control providing unit is coupled with the control unit and respectively supplies a current-power to each one of the lamp units. Wherein, for an individual replaced lamp unit, an individual current-power is adjusted in the power-control providing unit to produce a substantially equal luminance with the other lamp units, according to the total using time, the first relation and the second relation.

In another aspect of the present invention, the foregoing power-control providing unit can include an automatic luminance adjustment unit, coupled with the control unit in operation. Also and, a power inverter is coupled between the lamp units and automatic luminance adjustment unit for respectively providing the current-power to each one of the lamp units.

In another aspect of the present invention, the power-control providing unit can further comprise a manual luminance adjustment unit, for allowing a manual adjustment by a user.

In another aspect of the present invention, the present invention provides a luminance adjusting device, for automatically adjusting luminance of lamp unit according to an expected total using time. The luminance adjusting device comprises a storing unit, for storing a first relation of a lamp luminance versus a using time and a second relation of the lamp luminance versus an operation current-power. An input unit is used for inputting the expected total using time for a lamp unit. A power-control providing unit is coupled with the storing unit and the input unit, so as to determine a desired current-power for the lamp unit, and further for producing a desired lamp luminance.

The present invention also provides a method for managing luminance in a light module. The light module includes a plurality of lamp units, and each of the lamp units has an individual current-power being supplied.

The method for managing luminance comprises implementing the information of a first relation of a lamp luminance versus a using time and a second relation of the lamp luminance versus an operation current-power. Then, a total using time for the light module is accumulated. The lamp units have a present luminance at the present time with respect to the total using time. A desired lamp luminance is determined according to the total using time in first relation. A desired current-power is determined according to the desired lamp luminance in the second relation. Then, the current-power is applied to a specific one of the lamp units. As a result, when the specific one of the lamp units is used to replace an old lamp unit, the specific one has the desired luminance substantially equal to the present luminance.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 3:
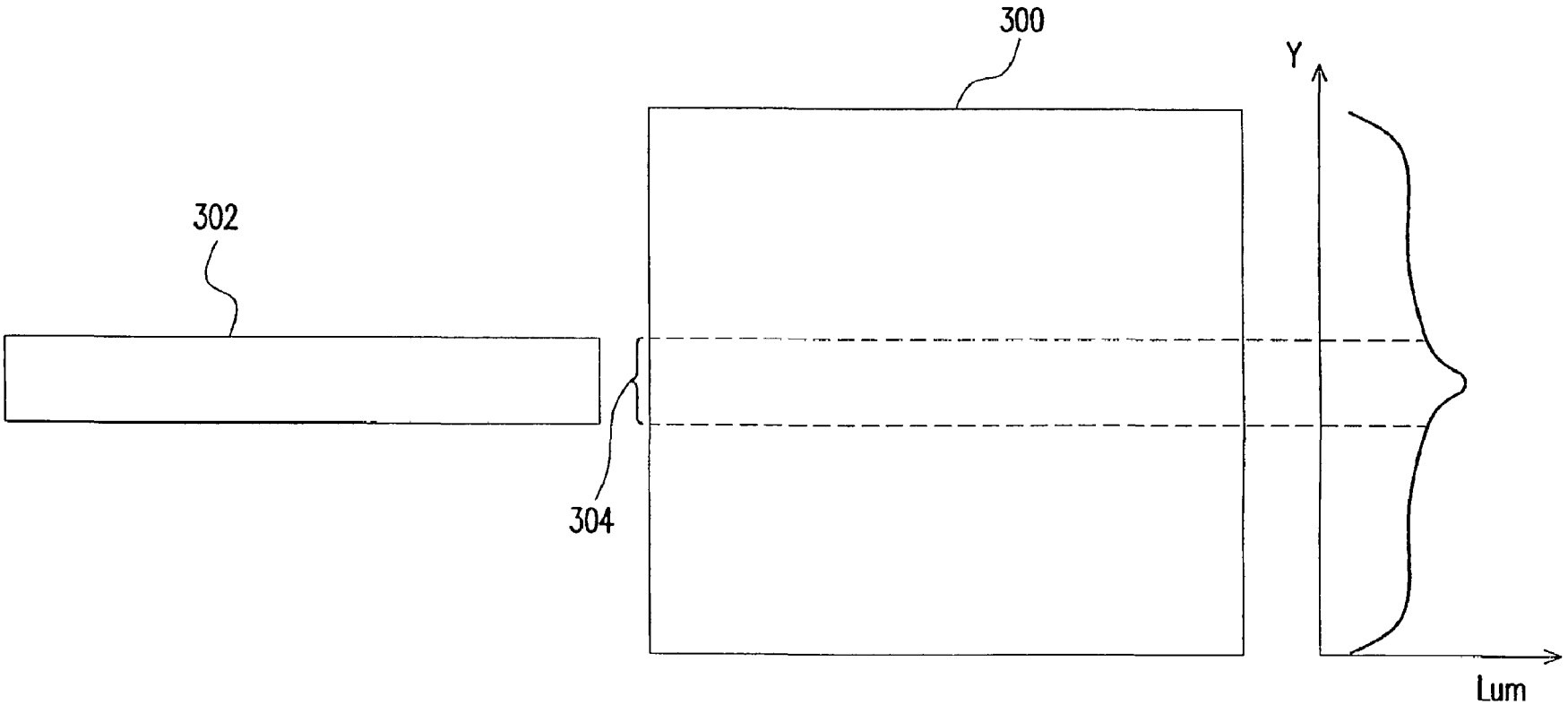
FIG. 3 is a drawing, schematically illustrating an issue of non-uniform luminance existing in the LCD device of FIG. 2.

As described in FIG. 3, the conventional light module at least has the disadvantage of non-uniform luminance in the display area when a lamp unit is replaced with a new one. The present invention has proposed a novel design of the light module to at least solve the foregoing conventional issues. An embodiment is provided as the example for descriptions but does not limit the present invention.

Figure 1:
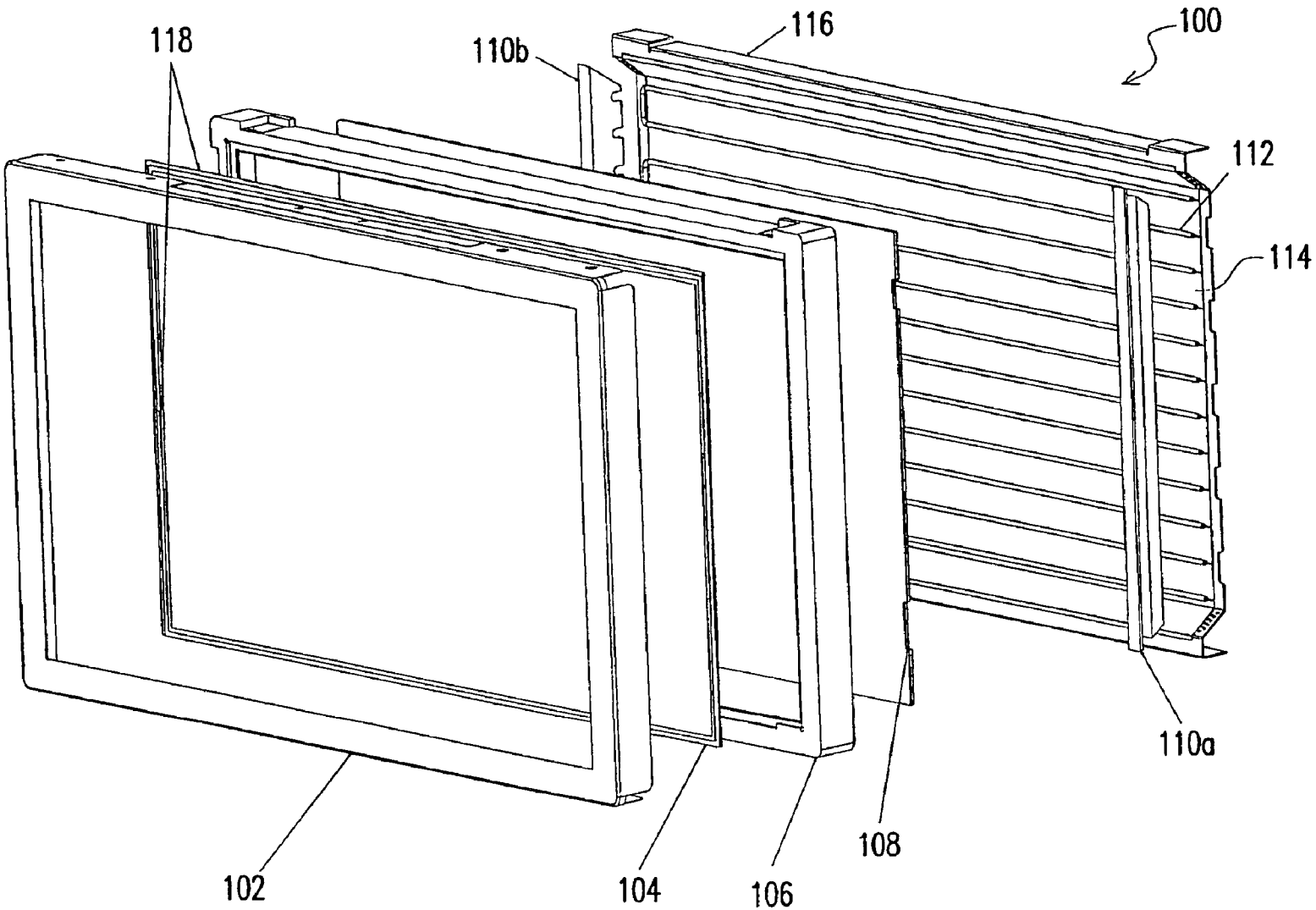
FIG. 1 is an exploded perspective drawing, schematically illustrating device elements of the conventional LCD device.
Figure 2:
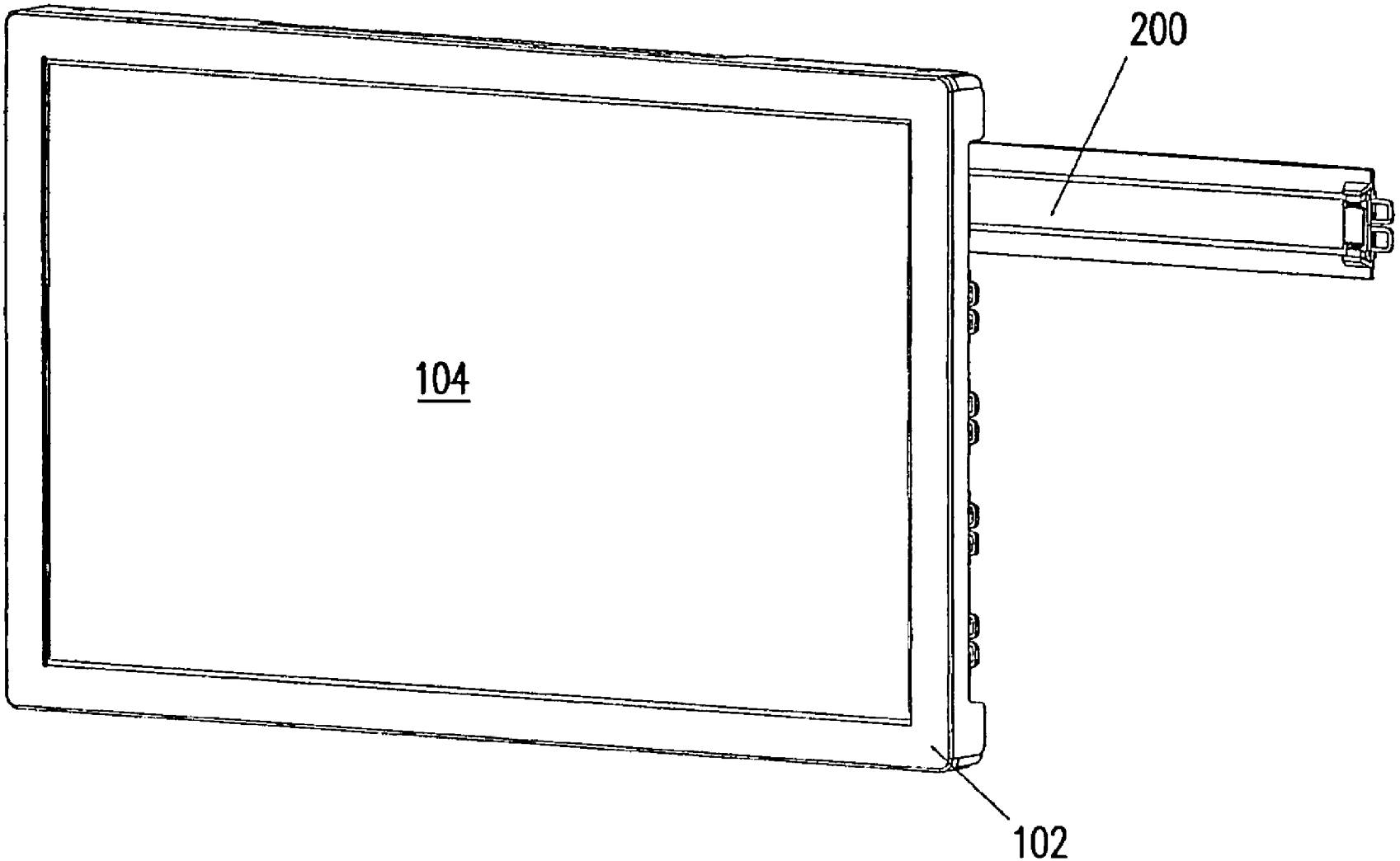
FIG. 2 is a perspective drawing, schematically illustrating another conventional LCD device with replaceable lamp unit of the light module.
Figure 4:
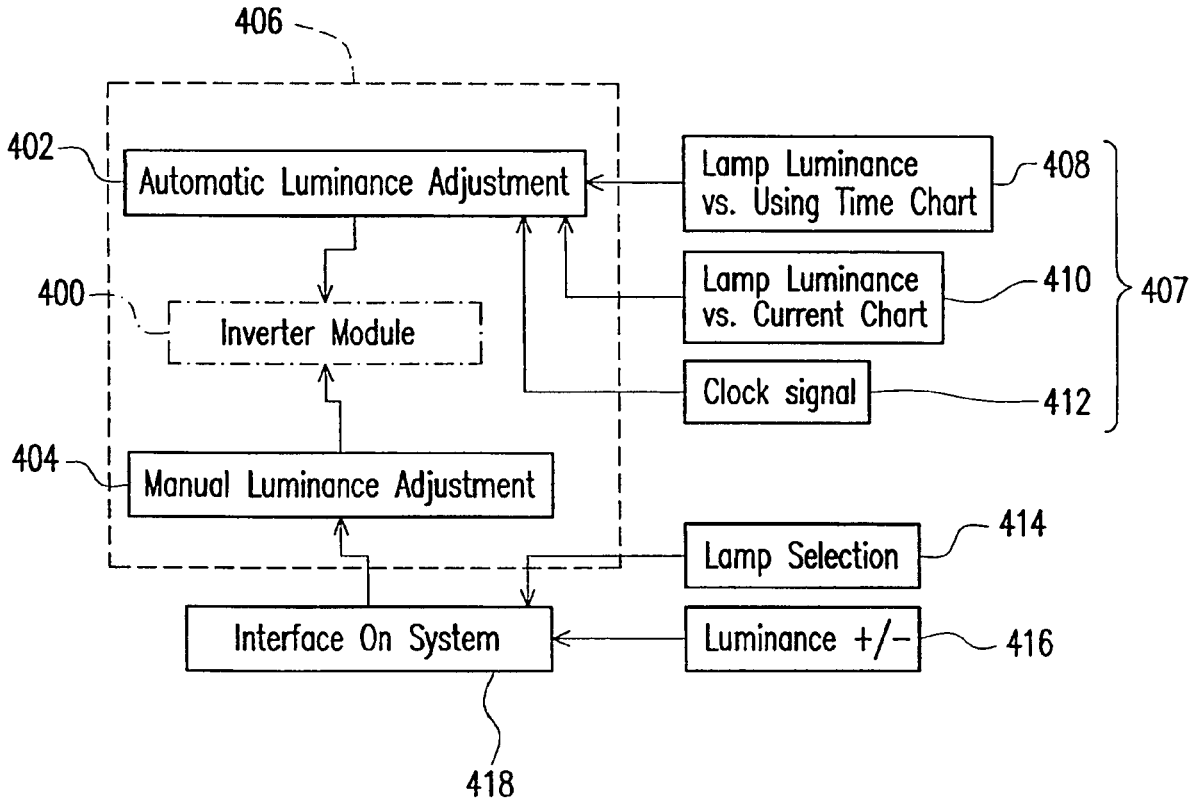
FIG. 4 is a block diagram, schematically illustrating the functional blocks to control the lamp unit, according to a preferred embodiment of the present invention.

The light module, such as a backlight module or a lamp module, basically includes a plurality of lamp units and a control structure. For example, the lamp units are shown in FIG. 2. However, each lamp unit can include a single lamp or multiple lamps with a design shape. It is not necessary to be limited to the lamp unit shown in FIG. 2. The control structure is for example shown in FIG. 4, which is a block diagram, schematically illustrating the functional blocks to control the lamp unit, according to a preferred embodiment of the present invention. In FIG. 4, the control structure includes a power-control providing unit 406, which can couple with a control unit 407 and respectively supply a current-power to each one of the lamp units.

The control unit 407 is implemented with the information of a first relation 408 of a lamp luminance versus a using time and a second relation 410 of the lamp luminance versus an operation current-power. The relation information 408 and 410 are to be described later in FIGS. 5-6. The relation information 408 and 410 basically function as a set of table, so that an expected lamp luminance for a specific lamp unit can be set, according to the total using time of the ambient lamp units. As a result, for example, the newly replaced lamp unit can have about the same luminance as the luminance of the ambient lamp units. In order to know the total using time of the light module, a clocking unit 412 with a clock signal is used to accumulate the using time when the light module is turned on. According to the total using time, then the first relation 408 can provide the expected lamp luminance at the present time. Then, the second relation 410 can determine the needed current-power to produce the expected lamp luminance. The control unit 407 provides the information of the relation information 408 and 410, and the total using time to the power-control providing unit 406. Then, the power-control providing unit 406 can supply the specific current-power to the specific lamp unit, which is a newly replaced one, for example. The foregoing three parts 408, 410, and 412 of the control unit 407 can be respectively implemented at proper places in the light module. For example, the control unit 407 can also be integrated into the power-control providing unit 406. The relations 408 and 410 can be stored in a storage device, such as a memory. The clocking unit 412 can be a time counter implements at a proper location in the light module or at proper location depending on the actual design.

Figure 5:
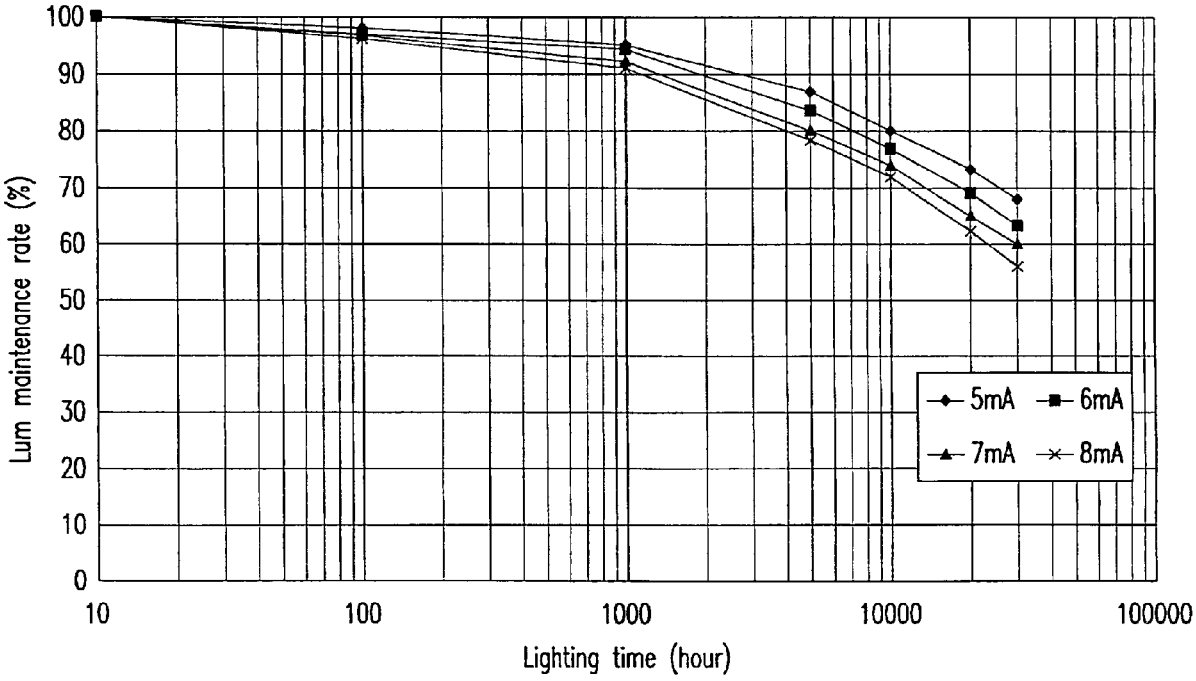
FIG. 5 is a drawing, schematically illustrating a relation between a lamp luminance versus a using time.
Figure 6:
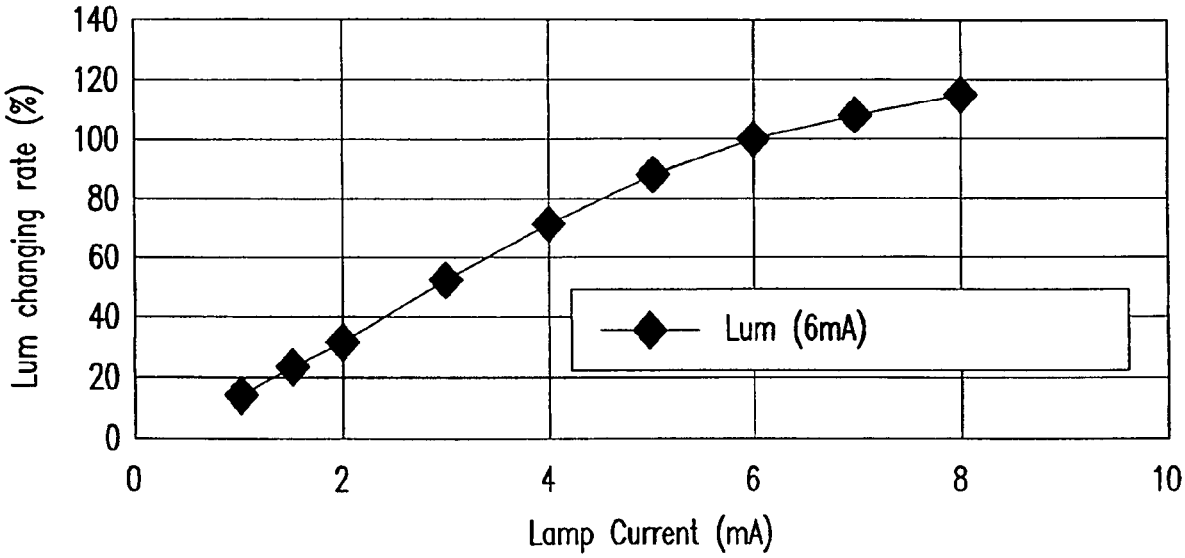
FIG. 6 is a drawing, schematically illustrating a relation of a lamp luminance versus a current-power.

Before further descriptions of the control structure in FIG. 4, the relations 408 and 410 are described in more detail. FIG. 5 is a drawing, schematically illustrating a relation between a lamp luminance versus a using time. FIG. 6 is a drawing, schematically illustrating a relation of a lamp luminance versus a current-power. The first relation 408 can be for example the relation curves with respect to the curves in several different current, applied to the lamp unit, as shown in FIG. 5. The curves can be described by multiple data points in a form of relation table. The other quantities can be obtained by interpolation, fitting, or any proper mathematic method. The lamp luminance at the beginning is set to 100%, for example. Then, for example, after the lamp unit has been operated for 10,000 hours, then, the luminance is expected to be about 80% when a current of 5 mA is applied to the lamp unit. For another curve, such as the current in 6 mA, it is about 77% after using 10,000 hours. In other words, if the light module has been operated for 10,000 hours, the lamp luminance for an individual the lamp unit is expected to the 80% while the lamp unit is applied with a current-power for producing 5 mA. However, a newly replaced one still remains at 100%. If this newly replaced one is not adjusted, then the conventional phenomenon in FIG. 3 occurs. In the invention, the clocking unit 412 can provide the total using time of the light module, and the present luminance can be simply determined by the relation information 408, which can be a table.

In FIG. 6, taking the situation with the operation current by 6 mA as the example, the changing rate of luminance of the lamp unit is varying with the current applied to the lamp unit. In accordance with the result from FIG. 5, for the new lamp unit, if the luminance of 77% of original is desired, then the current of about 4.3 mA should be applied to the light module, when the light module has been operated for about 10,000 hours. In other words, the original old lamp units, which have been operated for 10,000 hours, are applied with a current of 6 mA while the newly replaced lamp unit is applied by a current of about 4.3 mA. As a result, all lamp units of the light module are about the same in luminance. This is the mechanism of the present invention to adjust the luminance. Several curves like the one in FIG. 6 in different operation currents are respectively set up as another curves in the relation table.

In general, the information in FIG. 5 and FIG. 6 are implemented by the relation tables, which can be stored in a memory device, which is located in a proper place in the light module or an external storage location. This depends on the actual design.

Referring to FIG. 4 again, the power-control providing unit 406 is coupled with the control unit 407 to obtain the information to determine the desired current-power to apply to the specific lamp unit, which for example is a newly replaced one. The power-control providing unit 406 can include an automatic luminance adjustment unit 402 coupled with the control unit 407 in operation. A power inverter 400 is coupled between the lamp units (not shown in FIG. 4) and the automatic luminance adjustment unit 402 for respectively providing the current-power to each one of the lamp units. For the specific replaced lamp unit, a specific current-power is applied. Here, current-power means, for example, an operation voltage, which can produce the desired current to thereby produce the luminance. Based on the design principle described by the present invention, the actual implementation can be done by the person ordinary skilled in the art. For example, the automatic luminance adjustment unit 402 and the control unit 407 are integrated together. The power inverter 400 is under control by the automatic luminance adjustment unit 402 to provide the required current-power to the lamp.

In addition, the power-control providing unit 406 can also include a manual luminance adjustment unit 404, which can be operated with manual operation by a user. The user can adjust the lamp luminance for the selected lamp unit via a lamp selection unit 414, a manual adjusting unit 416, and an interface unit 418. The lamp selection unit 414 allows the user to select the specific lamp unit. The user applies a current-power to the selected lamp unit by adding or decreasing the quantity via the manual adjusting unit 416. As a result, the present invention has the automatic mode and the manual mode in operation. The more detail is described as follows.

Figure 7:
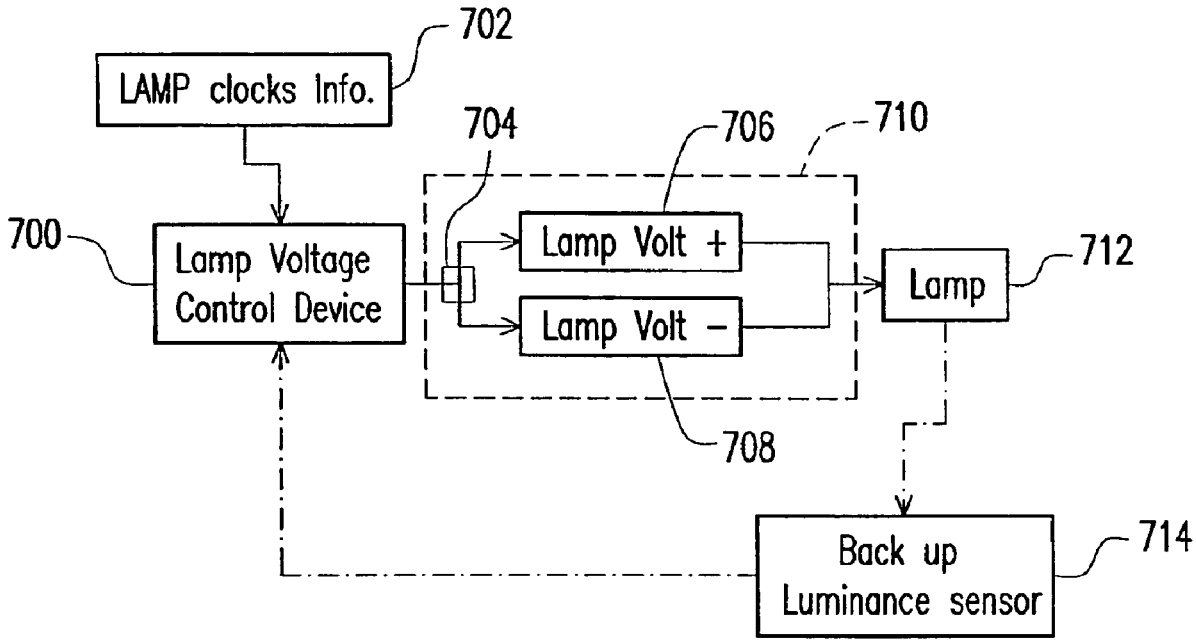
FIG. 7 is a block diagram, schematically illustrating the functional blocks when an automatic luminance adjustment mode is taken, according to the preferred embodiment of the present invention.

FIG. 7 is a block diagram, schematically illustrating the functional blocks when an automatic luminance adjustment mode is taken, according to the preferred embodiment of the present invention. The automatic mode can be implemented by the way shown in FIG. 7, based on the design principle in FIG. 4. In FIG. 7, the lamp voltage control device 700 can include the power-control providing unit 406 and the two relation tables 408 and 410. In this example, the clocking information 702 is input to the lamp voltage control device 700. The lamp voltage control device 700 decides the desired voltage and export the information to the voltage adjusting unit 710. The voltage adjusting unit 710 includes a switching unit 704 to decide the adjustment of increasing voltage or decreasing voltage, which has the corresponding circuit units 706 and 708. As a result, a voltage corresponding to a current is applied to the lamp 712. In addition, at least one back-up luminance sensor 714 can be optionally implemented at a preset location in the lamp units, so as to detect the actual luminance at the specific location. The back-up luminance sensor 714 feeds the measured signal back to the lamp voltage control device 700 as a reference for further adjustment. It should be noted that the design in FIG. 7 is just an example based on the design principle in FIG. 4.

Figure 8:
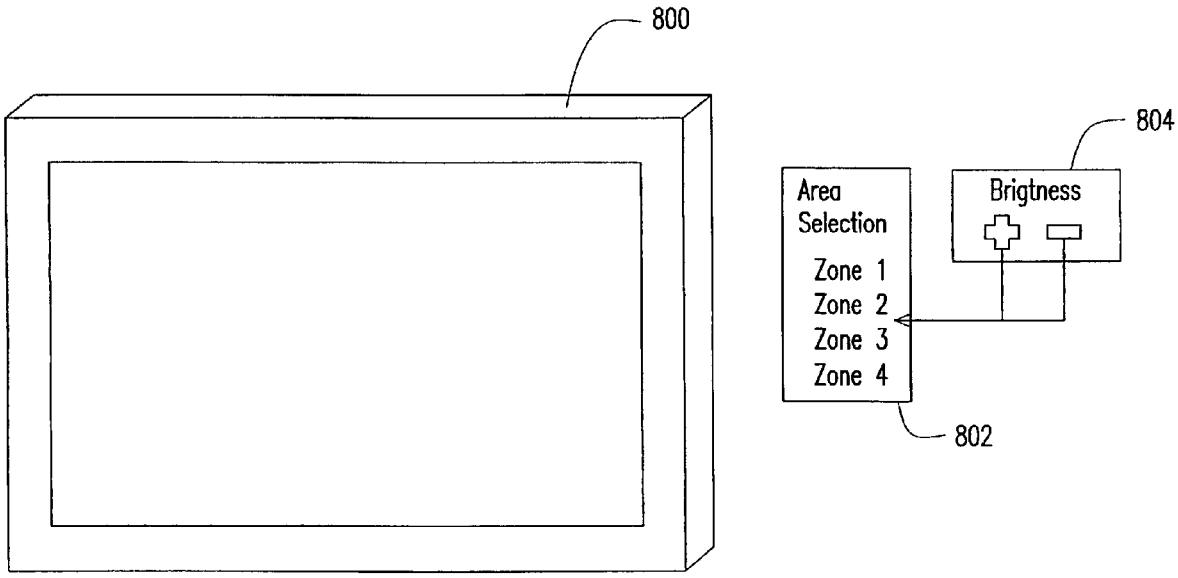
FIG. 8 is a drawing, schematically illustrating the design when a manual luminance adjustment mode is taken, according to the preferred embodiment of the present invention.

In addition, for the manual mode as shown in FIG. 8, the LCD panel 800 can be implemented with the selection device 802 and the adjustment device 804, which can be, for example, located on the LCD panel 800.

Figure 9:
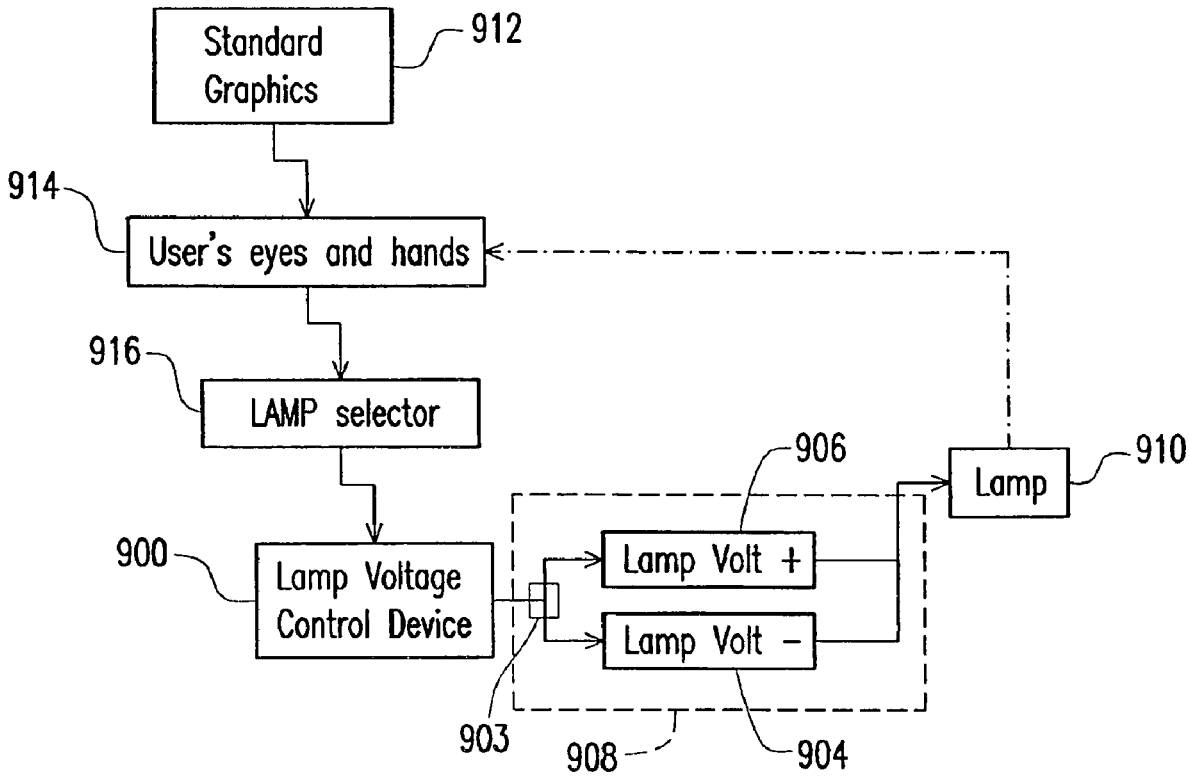
FIG. 9 is a block diagram, schematically illustrating the functional blocks when the manual luminance adjustment mode is taken, according to the preferred embodiment of the present invention.
Figure 10:
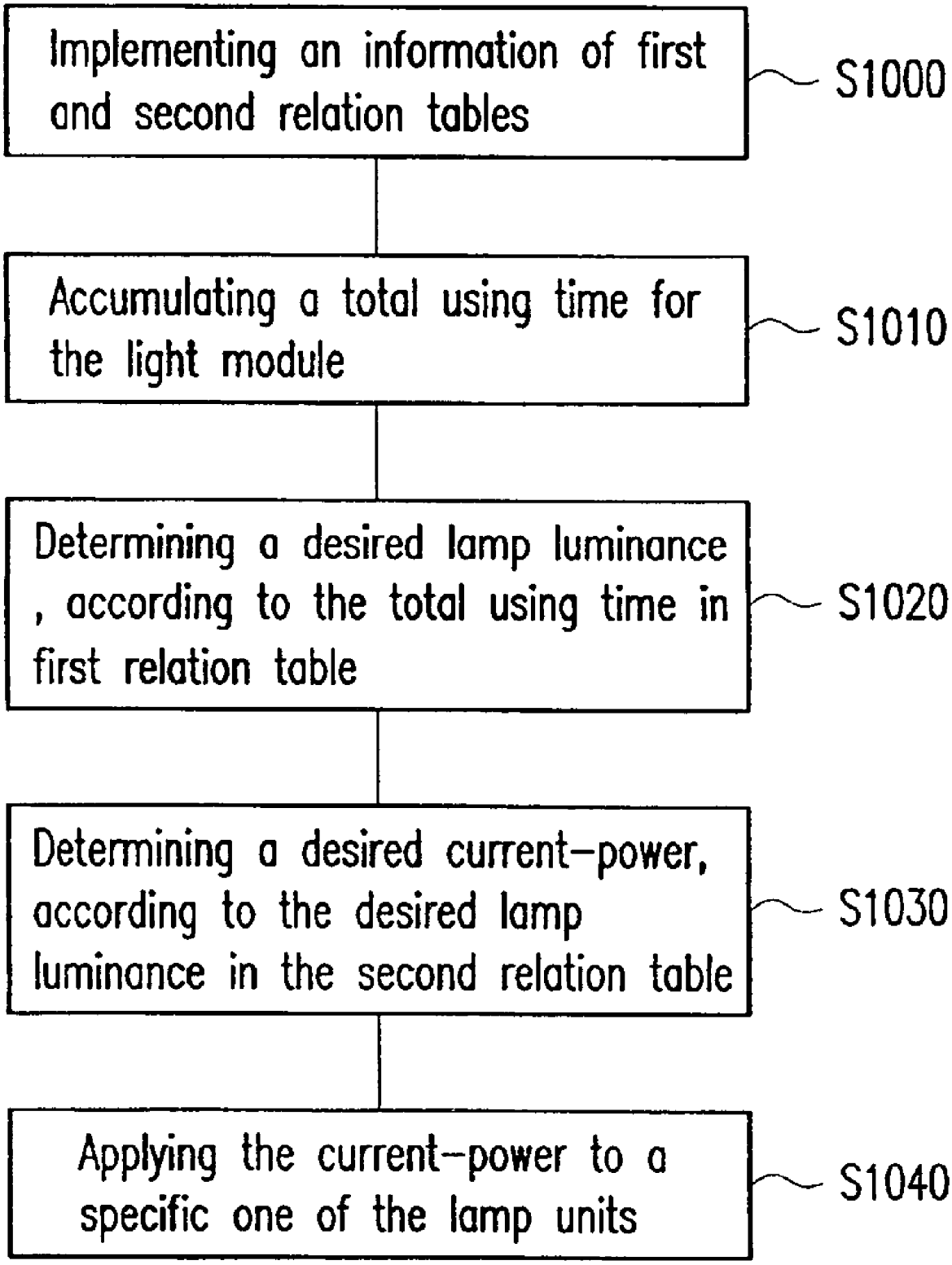
FIG. 10 is a process, schematically illustrating steps for managing luminance in a light module, according to an embodiment of the present invention.

FIG. 9 is a block diagram, schematically illustrating the functional blocks when the manual luminance adjustment mode is taken, according to the preferred embodiment of the present invention. In FIG. 9, the blocks 900, 908, and 910 are similar to the blocks 700, 710, and 712 in FIG. 7, in which the voltage adjusting unit 908 also includes the switching unit 903 and the circuit units 904 and 906. However, the input signal is determined by manual. For example, a standard graphic set 912 is presented to a user to see. The user 914 uses the hand and the eye to select and observe the standard graphic set 912. The lamp is selected by the lamp selector 916, and changes the current-power, based on the eye's observation on the standard graphic set 912.

The present invention has provided the embodiment in actual design. Alternatively, the present invention has also provides a method for managing the luminance in a light module. The light module includes, for example, a plurality of lamp units, and each of the lamp units has an individual current-power being supplied. The method for example includes, in step S1000, implementing an information of a first relation table of a lamp luminance versus a using time and a second relation table of the lamp luminance versus an operation current-power. Thereafter, in step S1010, a total using time for the light module is accumulated. At this moment, the lamp units have a present luminance with respect to the total using time. According to the total using time, a desired lamp luminance can be determined from the first relation table in step S1020. Here, the necessary interpolation from the data points may be necessary. A desired current-power, in step S1030, is then determined according to the desired lamp luminance in the second relation table. Next, in step S1040, the current-power is applied to a specific one of the lamp units, which is usually the newly replaced one to be selected.

However, if the user wants to adjust the specific one of the lamps, the manual manner can also be adapted as an alternating choice.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A luminance adjusting device, for automatically adjusting a lamp luminance of a lamp unit according to an expected total using time, the luminance adjusting device comprising:

a storing unit, for storing a first relation table of the lamp luminance versus a using time and a second relation table of the lamp luminance versus an operation current-power;

an input unit, for inputting the expected total using time for a first lamp unit; and a power-control providing unit, coupled with the storing unit and the input unit to determine a desired current-power for the first lamp unit for producing a desired lamp luminance, wherein the desired current-power is determined according to the first relation table, the second relation table and the expected total using time.

2. The luminance adjusting device in claim 1, wherein the input unit comprises a clocking unit for accumulating a time period when a second lamp unit other than the first lamp unit is turned on, so that the desired lamp luminance is substantially equal to a luminance for the second lamp unit.

3. The luminance adjusting device in claim 1, further comprises a luminance sensor, for detecting a local luminance and feeding the local luminance back to the power-control providing unit to adjust the desired lamp luminance.

4. A luminance adjusting device, for automatically adjusting a lamp luminance of a lamp unit according to an expected total using time, the luminance adjusting device comprising:

a storing unit, for storing a first relation table for determining a desired lamp luminance and a second relation table for determining a desired current-power;

an input unit, for inputting the expected total using time for a first lamp unit; and a power-control providing unit, coupled with the storing unit and the input unit to determine the desired current-power for the first lamp unit for producing the desired lamp luminance, wherein the desired current-power is determined according to the first relation table, the second relation table and the expected total using time; and a luminance sensor, for detecting a local luminance and feeding the local luminance back to the power-control providing unit to adjust the desired lamp luminance.

* * * * *